United States Patent [19]

Blase et al.

[11] 4,151,919

[45] May 1, 1979

[54] COKE OVEN HOPPER TRUCK INCLUDING SUPPORT FOR REMOVABLE FILLING COVER

[75] Inventors: Manfred Blase, Essen; Friedrich Isermann, Essen-Heisingen, both of Fed. Rep. of Germany

[73] Assignee: Didier Engineering GmbH., Essen, Fed. Rep. of Germany

[21] Appl. No.: 843,342

[22] Filed: Oct. 18, 1977

[51] Int. Cl.[2] ..... C10B 31/04

[52] U.S. Cl. ..... 414/164; 15/93 A; 212/4

[58] Field of Search ..... 214/18 PH, 35 R; 212/4; 15/93 A; 202/241, 262, 263

[56] References Cited

U.S. PATENT DOCUMENTS

| | | | |
|---|---|---|---|
| 3,281,880 | 11/1966 | Bender | 212/4 X |
| 4,072,239 | 2/1978 | Busbach | 214/18 PH X |

*Primary Examiner*—Robert G. Sheridan

*Attorney, Agent, or Firm*—Wenderoth, Lind & Ponack

[57] ABSTRACT

A coke oven hopper truck is movable along a coke oven cover which has therein filling holes closed by removable filling covers. The hopper truck has supported thereon a lifting device including an electromagnet which lifts and lowers the filling covers from and into the filling holes so that the filling covers may be removed from the filling holes, whereby coal may be charged through the filling holes into the coke oven chamber. The movable hopper truck has supported thereon repositories for supporting the filling covers after they have been removed from the filling holes by the lifting device. The repositories are movable with the hopper truck along the coke oven cover. The repositories have therein recesses dimensioned to receive therein the filling covers. Cleaning tools such as scrapers or brushes are provided along the edges of the recesses, and the lifting device rotates the filling covers against the cleaning tools to thereby clean the filling covers.

9 Claims, 7 Drawing Figures

COKE OVEN HOPPER TRUCK INCLUDING SUPPORT FOR REMOVABLE FILLING COVER

BACKGROUND OF THE INVENTION

The present invention relates to a coke oven hopper truck or lorry car of the type supporting a lifting device which is capable of removing filling covers from the filling holes of a coke oven chamber. More particularly, the present invention is directed to such a device wherein the lifting device includes at least one rotatable and vertically displaceable cover holder.

A device of this general type is disclosed in U.S. Pat. No. 1,609,919, which discloses a coke oven lorry car or hopper truck, in connection with which the covers of a coke oven chamber to be filled with coal are lifted by means of a lifting device, and after the coke oven chamber is filled, the covers are replaced on the filling holes. The lifting device in this known arrangement employs a plurality of electromagnets as cover holders equal to the number of filling holes of the coke oven chamber. When each holder places a respective cover back into the respective filling hole, the holder is rotated about its vertical axis such that the cover is pressed downwardly by the holder and is forced to rotate against its seat in the filling hole. The intention of this operation is to provide a better seal between the cover and the filling hole frame. However, this arrangement is associated with the disadvantage of requiring a significant amount of time to carry out this seating operation. Additionally, this arrangement is associated with the further disadvantage of risk of damage to at least one of the seat surfaces during the rotation of the covers. This arrangement is additionally associated with the still further disadvantage of soiling of the roof of the coke oven chamber. Additionally, there is by no means any guarantee of achieving a tight seal between the covers and the respective surfaces of the filling holes.

Even further, in this known arrangement the removed covers are placed on the roof of the coke oven chamber. When the covers are to be replaced, it is necessary to achieve very precise positioning of the hopper truck or lorry car. Finally, there is considerable danger in this known arrangement of damaging the oven cover when depositing thereon the filling covers.

SUMMARY OF THE INVENTION

With the above discussion in mind, it is the primary obejct of the present invention to provide a lorry car or hopper truck arrangement whereby it is possible to avoid the necessity of depositing the filling covers on the surface of the oven cover.

It is a further important object of the present invention to provide a lorry car or hopper truck arrangement whereby the overall time necessary for a coke oven chamber filling operation is reduced as compared with prior art arrangements, while at the same time ensuring a tight seal between the filling covers and the filling hole frames of the oven roof, without the danger of soiling or damaging either the upper surface of a coke oven chamber or the seat surfaces of the filling hole frames. The above objects are achieved in accordance with the present invention by the provision of a repository or storage-support arrangement which is supported by and movable with the hopper truck or lorry car, the filling covers being displaceable by the lifting device and deposited in the repository arrangement. Specifically, after coke produced in the oven chamber is removed therefrom, one of the filling covers is lifted by the lifting device and placed on the repository arrangement. The oven chamber is then in condition to be subjected to a degraphitizing or filling operation, and if necessary the lorry car or hopper truck may be moved to a conventional coal tower wherefrom the hopper truck is refilled with a new charge of coal, whereafter the hopper truck is returned to the filling hole and a new charge of coal is charged therethrough into the oven chamber. While such necessary and conventional operations are being conducted, the filling cover is being cleaned on the repository arrangement. This simultaneous cleaning of the filling covers while otherwise conventional and necessary operations are being carried out avoids the expenditure of any specific amount of time being employed exclusively for the cleaning of the filling covers, and thereby reduces the overall operational cycle of opening the filling hole, degraphitizing the oven chamber, filling the chamber with a new charge of coal, and reclosing the filling hole. Furthermore, by so cleaning the filling covers, it is possible to eliminate risk of damage to the seat surfaces and to thereby avoid the risk of leaks.

In accordance with a further preferred feature of the present invention, the repository arrangement is provided with a recess into which the filling cover may be deposited by the lifting device. Such recess may include cleaning tools such as scrapers and/or brushes which are mounted in a stationary manner within the recess. The filling cover may be pressed by the lifting device against the cleaning tools while the cover holder of the lifting device is rotated, to thereby rotate the cover against the cleaning tools. It will be apparent that this feature of the present invention is clearly advantageous, inasmuch as the filling covers previously had to be cleaned manually.

BRIEF DESCRIPTION OF THE DRAWINGS

Other objects, features and advantages of the present invention will be apparent from the following detailed description of a preferred embodiment thereof, with reference to the accompanying drawings, wherein.

DETAILED DESCRIPTION OF THE INVENTION

On an oven roof 1 of a coke oven, a lorry car or hopper truck 20 is mounted to be displaced in a known manner along rails in a direction indicated by arrow P1. It is intended that a coal tower for recharging lorry car 20 be arranged adjacent one of the endmost positions of movement of the lorry car. However, inasmuch as such coal tower forms no portion of the present invention and is otherwise conventional, the illustration thereof is omitted from the present drawings.

Figure 5:
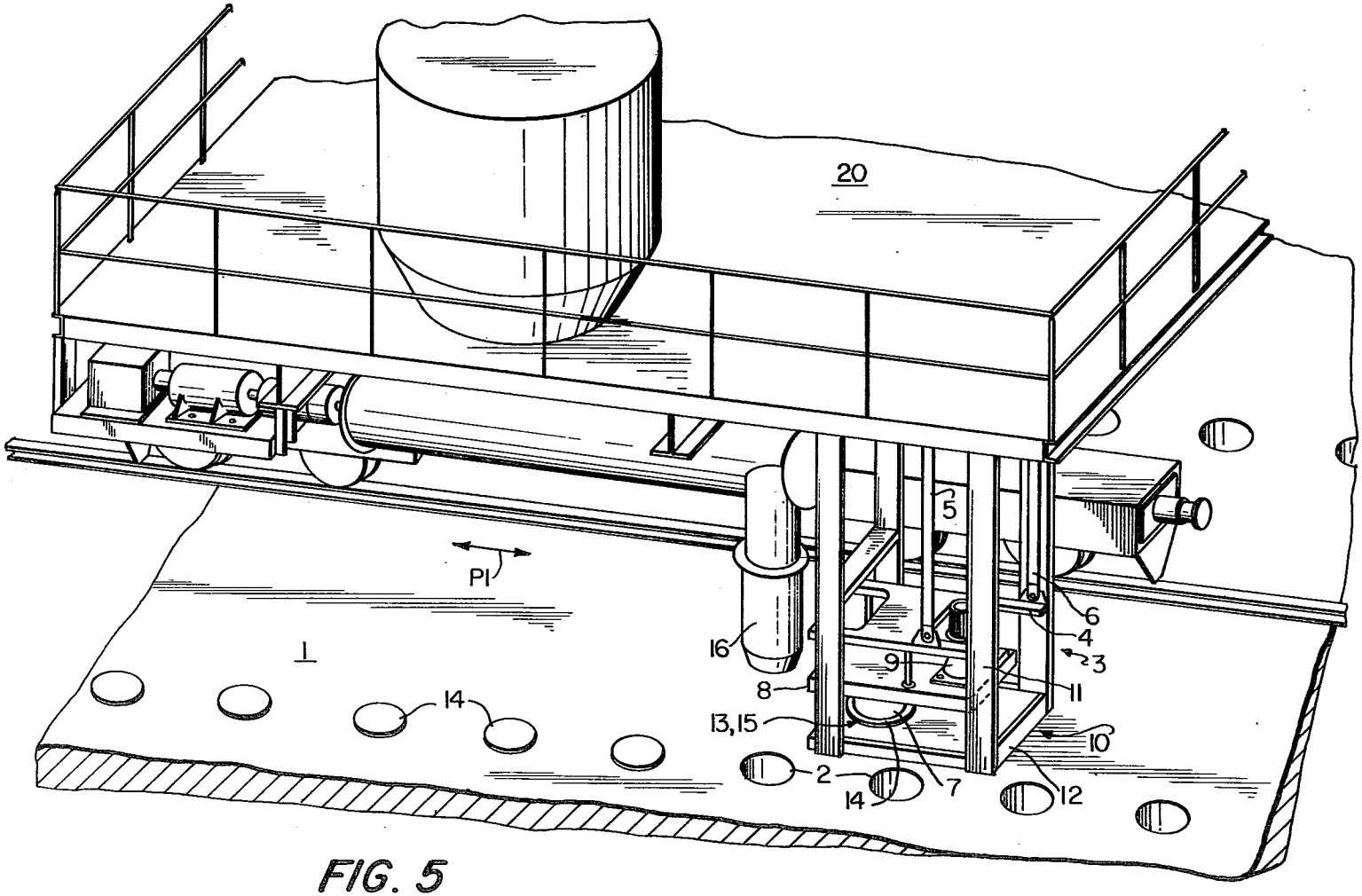
FIG. 5 is a partial perspective view of the roof of a coke oven chamber and a lorry car or hopper truck positioned thereabove.

Through the oven roof or oven cover 1 extend a plurality of filling holes 2. The filling holes 2 are arranged in rows as indicated in FIG. 5, and the filling holes of each row are preferably aligned in columns in directions transverse to the rows. Each of the filling holes 2 are closed during normal operation of the oven in a gas-tight manner by means of filling hole covers 14 which are normally merely placed within the filling holes 2. This arrangement can be more clearly seen in FIGS. 1 and 5 of the drawings.

A lifting device 3 is supported and mounted on the hopper truck or lorry car 20. The specific manner of attachment and support of lifting device 3 to the hopper truck 20 is not illustrated in the present invention, inasmuch as such attachment in and of itself forms no portion of the present invention and would be readily understood by those skilled in the art. However, the lifting device 3 includes a freely movable transverse member 4 preferably arranged parallel with oven roof 1. The transverse member 4 is supported by lifting mechanisms 5 and 6 which are mounted on and supported by lorry car 20 in a manner such that they are horizontally displaceable with respect to lorry car 20. Expansion and contraction of lifting mechanisms 5 and 6 will allow for lowering and raising of transverse member 4. An electromagnet 7 forms a cover holder and is rotatably mounted on transverse member 4. Rotary motion is imparted to electromagnet 7 in a conventional manner, for example by means of a chain drive 8 (shown within a housing in FIG. 5) which is connected through worm gearing to a motor 9 which is mounted on transverse member 4. Current may be supplied to electromagnet 7 by means of conventional slip-ring elements incorporated into the electromagnet. Such slip-ring elements in and of themselves form no portion of the present invention and would be readily understood by those skilled in the art, and thus are not shown or further described herein.

The lorry car or hopper truck 20 also has associated therewith conventional coal-filling connections 16 which may be moved into positions to fill coal through filling holes 2 into the oven chamber. Connections 16 can be lifted and lowered in a conventional manner to align with and extend into filling holes 2. Such connections 16 are conventional and in and of themselves form no portion of the present invention and are thus not further described or illustrated.

In accordance with the present invention a repository arrangement 10 is mounted on and supported by the hopper truck or lorry car 20. Repository arrangement 10 operates to support therein and clean the filling covers 14 after removal thereof by the lifting device from the filling holes 2. Repository arrangement 10 is suspended by a supporting structure such as beams 11 which are suitably attached to the hopper truck 20. Thus, the repository structure 10 is fixedly mounted with respect to the hopper truck or lorry car 20, but is movable therewith.

Figure 6:
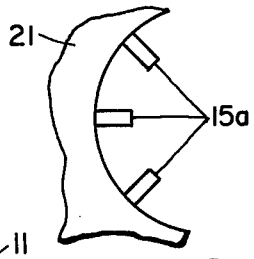
FIGS. 6 and 7 are enlarged partial plan views showing details of alternative cleaning devices which may be used in the arrangement of the present invention.
Figure 7:
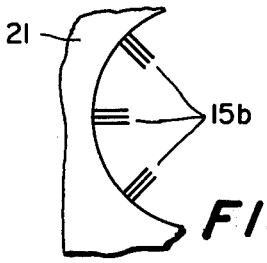

Beams 11 support a repository plate memory 12 which preferably extends in a direction parallel to the upper surface of oven roof 1. Member 12 has therein a recess 13 generally adapted to correspond in size and configuration to the openings of filling holes 2, such that recess 13 may receive therein a filling cover 14. Around the inner edge of recess 13 are arranged cleaning devices 15 which preferably may be in the form of any type of scraper devices, such as shown at 15*a* in FIG. 6, or brush devices, such as shown at 15*b* in FIG. 7, which would be understood by those skilled in the art as being capable of achieving cleaning of the edge of cover 14 upon the rotation thereby against cleaning devices or tools 15.

Cover 14 may be lifted by electromagnet 7 upon contraction of lifting mechanisms 5 and 6. Thus, by horizontal shifting of transverse member 4 in the direction indicated by arrow P2, the thus removed cover 14 can be displaced to a position above recess 13 in repository plate member 12. Expansion of lifting mechanisms 5 and 6 will then lower cover 14 into recess 13 and into contact against cleaning tools 15. Rotation of electromagnet 7 will thus rotate cover 14 against cleaning tools 15, thereby removing soil and incrustment from the seating and sealing edge of cover 14.

It is to be understood that the lorry car or hopper truck 20 may be of a construction to include a lifting device 3 and repository arrangement 10, of the construction discussed above, for each row of filling holes 2 and covers 14.

Figure 4:
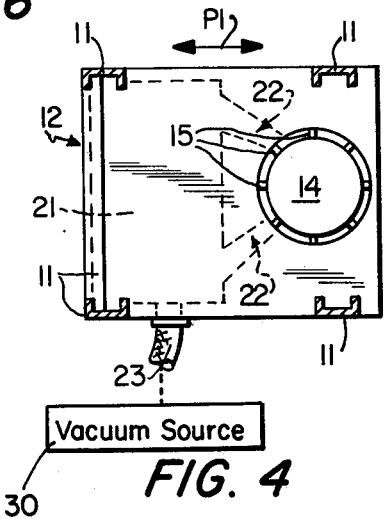
FIG. 4 is a plan view taken approximately along line IV—IV of FIG. 3.

In accordance with a further feature of the present invention, each repository arrangement 10 may be provided with a suction arrangement to remove from the area of the repository arrangement the soil and incrustment removed from the covers 14 by the cleaning tools 15. Specifically, plate member 12 may have on the lower surface thereof a recess forming a suction chamber 21 which may be closed by a bottom plate 24 which in turn may be conveniently removed to provide a thorough cleaning of the repository arrangement. Suction chamber 21 may be connected by suction ducts 22 to a ringshaped duct 22' formed beneath the cleaning tools 15. Also, a suction hose 23 connected to a suitable vacuum source, shown schematically at 30 in FIG. 4, may be connected to suction chamber 21. Therefore, when the repository arrangement is operated in the above described manner to clean the sealing and seating edge of a cover 14, the dirt removed by cleaning tools 15 will be drawn into circular duct 22' and be withdrawn therefrom via suction ducts 22, suction chamber 21 and suction hoses or connections 23. It will be understood that in accordance with the present invention all of the repository arrangements 10 supported on a given lorry car or hopper truck 20 may be connected to a common suction source.

Although it is believed that the operation of the device will be apparent from the above description, the operation will now be briefly described.

Figure 1:
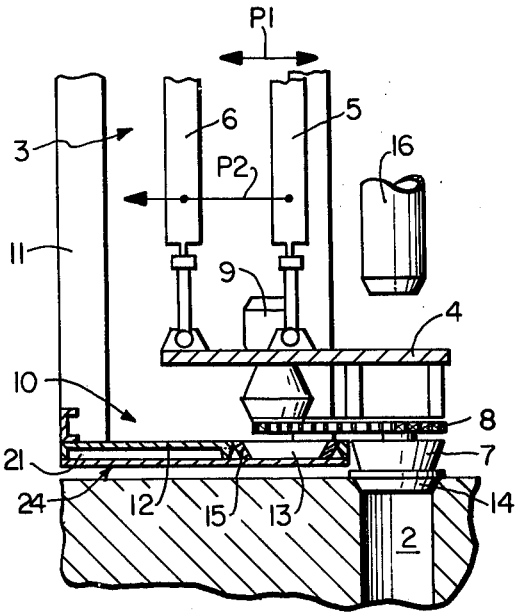
FIG. 1 is an elevation view, partially in section, illustrating the novel repository arrangement of the present invention as associated with a hopper truck lifting device and a coke oven cover having therein a filling hole closed by a filling cover.
Figure 2:
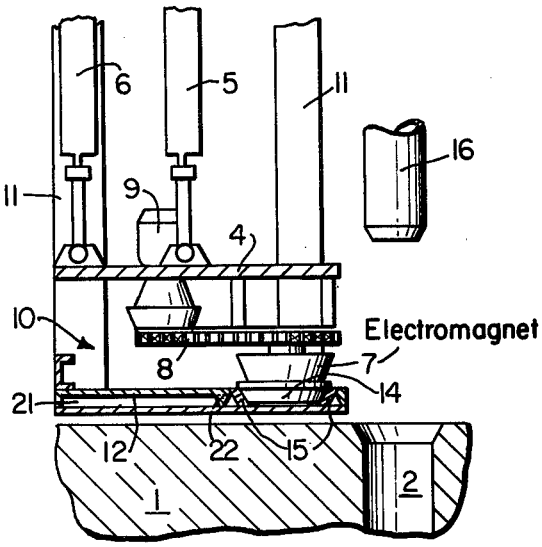
FIG. 2 is a view similar to FIG. 1, but showing the filling cover removed from the filling hole and deposited in the repository arrangement and held therein in the cleaning position by the lifting device.

In the position shown in FIG. 1 of the drawings, the lorry car 20 is positioned with the lifting device 3 thereof adjacent a selected filling hole 2 of a row of filling holes. As discussed above, it is to be understood that the lorry car 20 may have a plurality of lifting devices, one each for each of a plurality of rows of filling holes. The lifting mechanisms 5 and 6 are expanded to place electromagnet 7 in contact with cover 14 to be removed from the selected filling hole. The necessary electric current is supplied to the electromagnet 7 through the above discussed conventional slip-ring elements. Accordingly, cover 14 is firmly attracted and held by electromagnet 7. Lifting mechanisms 5 and 6 are contracted to raise transverse member 4, electromagnet 7 and the cover 14 held thereby, thus lifting the cover 14 from the filling hole to a position above the plane of repository plate member 12. The lifting device 3 is then shifted in the direction of arrow P2 by means of a conventional arrangement, such as a known spindle arrangement, until the cover 14 supported by electromagnet 7 is positioned above recess 13. Lifting mechanisms 5 and 6 are then expanded to lower electromagnet 7 and cover 14 until they are in the position illustrated in FIGS. 2 and 5 of the drawings, i.e. with cover 14 in recess 13. Operation of motor 9 then causes electromagnet 7 to be rotated, via the intermediary of chain drive 8, and at the same time the lifting device presses cover 14 against cleaning tools 15. This causes cleaning tools 15 to clean soil or incrustment from the sealing and seating edge of the cover 14. At the same time, operation of the above described suction removal arrangement will withdraw the thus removed soil and incrustment from the area of the repository arrangement.

Figure 3:
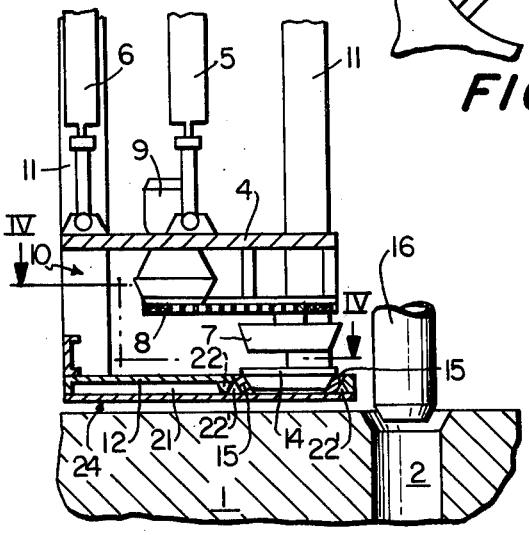
FIG. 3 is a view similar to FIGS. 1 and 2, but with the lifting device removed from the filling cover and with a filling connection of the hopper truck shown in a position to fill a new charge of coal through the filling hole.

The conventional coal filling connection 16 may then be lowered in a known manner to the position shown in FIG. 3 of the drawings so that a new charge of coal may be supplied through the thus opened filling hole into the coke oven chamber.

When the refilling operation is complete, filling connection 16 is again lifted from filling hole 2, lifting device 3 operates to raise electromagnet 7 and cover 14 from the repository arrangement 10, and the lifting device is moved in a direction opposite to arrow P2 until the cover is again positioned over filling hole 2. Then the lifting device is expanded to lower cover 14 into filling hole 2, i.e. the position shown in FIG. 1 of the drawings. Power is then removed from electromagnet 7, and the electromagnet 7 releases the cover 14 which then closes the filling hole 2. Since the cover 14 was previously cleaned, there is guaranteed a gas-tight seating engagement between the cover 14 and the filling hole 2. Futhermore, since in accordance with the present invention the cover 14 is cleaned during the time that other necessary operations are being carried out, the achievement of a gas-tight closing of filling hole 2 does not require the expenditure of additional work and time.

It is of course to be understood that in the event that the cover 14 is to be retained in recess 13 for any relatively long period of time, the electromagnet 7 may be deenergized and raised to the position shown in FIG. 3 of the drawings.

In addition to the above specifically described operational sequence, it is to be understood that once a selected cover 14 is removed from the respective filling hole and deposited in recess 13, then the lorry car may be moved away from hole 2, such as to receive an additional charge of coal, and then returned to the respective filling hole 2. During such operation the cover 14 may be undergoing a cleaning operation. Again, it will be apparent that the cleaning operation does not in any way add additional time or work to otherwise necessary operations.

It will be apparent that various modifications may be made to the above specifically described structural arrangements without departing from the scope of the present invention.

What is claimed is:

1. In a coke oven hopper truck arrangement of the type including a hopper truck movable along a coke oven cover having therein filling holes closed by removable filling covers, said hopper truck having supported thereon at least one lifting device including an electromagnet for removing and replacing said filling covers so that coal may be charged through said filling holes into the coke oven chamber, the improvement comprising:

repository means, supported by and movable with said hopper truck, for supporting said filling covers after removal thereof from said filling holes by said lifting device, said repository means comprising a supporting member having therein a recess dimensioned to receive a said filling cover, and cleaning tools positioned around the edge of said recess for cleaning said filling cover.

2. The improvement claimed in claim 1, wherein said cleaning tools comprise scrapers.

3. The improvement claimed in claim 1, wherein said cleaning tools comprise brushes.

4. The improvement claimed in claim 1, wherein said cleaning tools are fixed to said repository means, and said lifting device comprises means for displacing said filling covers against said fixed cleaning tools.

5. The improvement claimed in claim 1, wherein said lifting device includes means for rotating said filling cover in said recess and for thereby moving the edge of said filling cover against said cleaning tools.

6. The improvement claimed in claim 1, wherein said supporting member extends parallel to said coke oven cover.

7. The improvement claimed in claim 1, wherein said supporting member has therein a vacuum chamber connected to a vacuum source, and vacuum ducts extending from said vacuum chamber to the area adjacent said cleaning tools, such that soil removed by said cleaning tools is removed via said vacuum ducts and vacuum chamber.

8. The improvement claimed in claim 1, wherein there is provided a single lifting device which is displaceable along said hopper truck in a direction transverse to the direction of movement of said hopper truck along said coke oven cover.

9. The improvement claimed in claim 1, wherein said hopper truck supports thereon a plurality of lifting devices and repository means, one each for each of a plurality of rows of said filling holes and filling covers.

* * * * *